US006536745B2

(12) United States Patent
Roark

(10) Patent No.: US 6,536,745 B2
(45) Date of Patent: Mar. 25, 2003

(54) FENCING UNIT WITH T-POST ENGAGEMENT MEANS AND LATERAL BRACING SYSTEM USING SAME

(76) Inventor: Harold Dean Roark, 9970 Hwy. 421 S., Trade, TN (US) 37691

( * ) Notice: Subject to any disclaimer, the term of this patent is extended or adjusted under 35 U.S.C. 154(b) by 0 days.

(21) Appl. No.: 09/940,017

(22) Filed: Aug. 27, 2001

(65) Prior Publication Data

US 2003/0038281 A1 Feb. 27, 2003

(51) Int. Cl.[7] ..... E04H 17/14
(52) U.S. Cl. ..... 256/65.01; 256/65.02
(58) Field of Search ..... 256/65.01, 65.02, 256/65.11, 65.14, 59, 21, 22, 1; 403/237, 230, 233, 235, 241, 247, 253; 248/297.31; 52/150

(56) References Cited

U.S. PATENT DOCUMENTS

| | | | | | |
|---|---|---|---|---|---|
| 2,147,496 | A | * | 2/1939 | Nelson | 52/150 |
| 4,349,181 | A | | 9/1982 | Asher et al. | |
| 4,533,906 | A | | 8/1985 | Amir | |
| 4,763,879 | A | | 8/1988 | Wasicek et al. | |
| 4,889,322 | A | | 12/1989 | Wagner | |
| 4,893,787 | A | | 1/1990 | Watson | |
| 4,936,550 | A | * | 6/1990 | Wickham et al. | 148/666 |
| 4,979,724 | A | | 12/1990 | Williams | |
| 5,042,780 | A | | 8/1991 | Yearwood | |
| 5,061,109 | A | | 10/1991 | Miller | |
| 5,139,235 | A | | 8/1992 | Kilmer | |
| 5,192,055 | A | | 3/1993 | Grigg et al. | |
| 5,356,101 | A | | 10/1994 | Mallory | |
| 5,460,344 | A | | 10/1995 | Mallory | |
| 5,518,333 | A | * | 5/1996 | Cienkus et al. | 256/59 |
| 5,593,143 | A | * | 1/1997 | Ferrarin | 248/68.1 |
| 5,681,030 | A | | 10/1997 | Nall | |
| 6,443,433 | B1 | * | 9/2002 | Auldridge | 256/68 |

FOREIGN PATENT DOCUMENTS

| | | |
|---|---|---|
| FR | 492413 | 7/1919 |
| FR | 2264149 | * 10/1975 |
| GB | 1136611 | 12/1968 |
| GB | 1557781 | 12/1979 |

* cited by examiner

*Primary Examiner*—James R. Brittain

(57) ABSTRACT

A fencing unit that can be utilized as a bracing member for a T-post type fence. The fence unit includes a front face member having front and back surfaces, a leg member rigidly affixed to the back surface and substantially perpendicular to the front face member so that the juncture of the front face member and the leg member substantially forms a "T" shaped cross-section; and engaging means for engaging the fence unit with a portion of another T-post. Another aspect of the present invention is a braced T-post fence assembly wherein the fencing unit is used as a bracing member between two spaced apart T-posts. A method for forming a braced fence assemblage or arrangement is also provided by inserting bracing member between two substantially vertical T-posts.

20 Claims, 3 Drawing Sheets

FENCING UNIT WITH T-POST ENGAGEMENT MEANS AND LATERAL BRACING SYSTEM USING SAME

BACKGROUND OF THE INVENTION

1. Field of the Invention

The present invention relates to fence post construction, and more particularly to a T-post fencing unit. Another aspect of the present invention is a lateral bracing arrangement or assemblage that may be used for a corner fence assembly utilizing at least one T-post fencing unit described herein. The present invention further relates to a method for forming a braced fencing arrangement.

2. Background of the Invention

Fence posts are widely used in the construction of fences for a variety of purposes, such as, animal management, boundary demarcation and the like. Currently, metal fence posts having a "T" cross-section configuration, hereinafter "T-posts", are widely used for both temporary and permanent fencing units. Conventionally, T-posts have a flat vertical face with a series of spaced apart lugs or projections that are substantially perpendicular to the face and aligned along the longitudinal axis of the T-post. These lugs provide a means to facilitate attachment of wire, such as barbed, chicken or electric, in constructing the fence.

Although these T-posts are relatively low in cost and are easily installed using a sledge hammer or other manual driving device, T-posts are not without their problems. One problem is that T-posts have little lateral strength and can be readily displaced from their vertical position when a lateral force is applied, such as, when constructing a corner assembly using such T-posts. The end and corner units of such fences may be subjected to static forces of upwards from 3000 to 5000 pounds. This force is attributed to the tension in the wire and the change in direction of the fence at a corner. This force must be counteracted if the fence is to remain standing and/or the wire to remain taut.

To overcome this problem, corner T-post(s) must be reinforced with additional bracing. In the past, wooden posts have been used. However, a problem with using two types of materials is that often a metal T-post will last as long as 40 years, whereas a wooden post may have a life of only 10 years. Additionally, today's wooden posts are typically treated with a chemical preservative to add to the useful life of the post. The hazards of such wood preservatives is currently a topic of debate and may not be safe for human contact or the environment. Moreover, it is fairly widely accepted that it is more economical to install fencing components which have an approximate equal and long useful life. This reduces maintenance and labor costs associated with the fence during its useful life.

In the past, the shape of the T-post did not facilitate the simple attachment of brace members. Generally, bracing was accomplishes by a rather complex assembly of additional parts, which may have required the drilling holes in the T-post, digging holes for bracing units, and/or the pouring of concrete. All of which detract from the ease of T-post installation.

Various devices have been developed for attaching brace members and the like to fence posts. For example, U.S. Pat. No. 4,763,879 issued to Wasicek et al. on Aug. 16, 1988 discloses a connector assembly having a collar with three openings circumferentially and equidistantly positioned around the collar. The connector further includes a wedge member for tightening the collar. The wedge member is an L-shape configuration and includes a notch. In use, the collar is positioned over the T-post and the wedge member is positioned so that the notch receives the central web portion of the post. The connector assembly also includes a deformable wire member to secure the wedge member to the collar when it is finally positioned and to prevent the parts separation.

U.S. Pat. No. 4,893,787 issued to Watson on Jan. 16, 1990 discloses a corner post assembly having a steel main post. A laterally extending steel brace member having a body portion that can be positioned at ground level is welded to the steel main post. A bracing strut is welded between the main post and the brace member. The corner post assembly also includes a downturned leg portion. In use, the lower portions of the main post and the leg portion of the brace member are placed in parallel post holes so that the brace member absorbs the static load on the main post arising from the tension in the fencing wires. The corner post assembly further includes a plurality of stabilization plates welded to the main post and to the brace member.

U.S. Pat. No. 5,061,109 issued to Miller on Oct. 29, 1991 discloses bracing members and a method for using the bracing members for a metal T-posts. The bracing members have two substantially identical elongated first members each having U-shaped or hooked oppositely disposed ends. Each hooked end of the first bracing member is apertured to receive a single bolt. The first bracing members are structured for spanning horizontally between and attaching with the hooked portions placed around two T-posts. In use, one first bracing member is placed adjacent to the ground, and one first bracing unit is placed adjacent to the upper ends of the T-posts. Also included in the assembly is an elongated straight bracing member having bolt receiving holes at the two oppositely disposed terminal ends. The straight bracing member is used for a diagonal brace between the two vertical T-posts, extending at an angle from an attachment point to a hook of the upper bracing member adjacent one T-post downward at an angle to an attachment point to the hook of the lower bracing member adjacent the other T-post. Nuts and bolts are used to attach the bracing members on T-posts installed in the ground. The bracing members having the hooked ends have been structured in a manner which allows the brace to be used as a measuring gage for quickly determining the proper distance two T-posts should be set apart prior to bracing.

U.S. Pat. No. 5,042,780 issued to Yearwood on Aug. 27, 1991 discloses a T-post brace having a transverse bar adjacent one end portion. The other end of the brace is pivotally connected with an open bracket which frictionally grips opposing sides of a T-post when the brace is engaged with the T-post and driven into the soil during the last earth penetrating movement of the T-post.

U.S. Pat. No. 4,349,181 issued to Asher et al. on Sep. 14, 1982 discloses an end or corner fence post construction having a main upright post supported by a main brace. The main post has an anchoring plate attached near its lower end i.e., below ground level. The main brace unit also has a bearing plate which is buried below ground level. A cross brace is attached at one end to the main post and the other end attached to the main brace.

U.S. Pat. No. 4,889,322 issued to Wagner on Dec. 26, 1989 discloses an apparatus for bracing T-posts. The apparatus includes a collar having one or more enclosed slots is secured between the lugs of the T-post by a wedge. The slots in the collare are used to receive attachment members, such as sockets for the cross-brace member.

U.S. Pat. No. 4,979,724 issued to Williams on Dec. 25, 1990 discloses a T-posts bracing system having a hollow collar member adapted to slideably fit over a fence post and leave a space between the collar member interior and the fence post. The bracing system also includes a double action expansion wedge for attaching a collar to a T-post fence. The double action expansion cam wedge secures the collar between adjacent lugs on the post by tightly wedging the collar and post together. The double action expansion causes the top edge of the collar and the bottom edge of the collar both to be wedged against the post to hold the collar in alignment with the post.

U.S. Pat. No. 5,139,235 issued to Kilmer on Aug. 18, 1992 discloses a fence post unit having an augered base, a removable extension piece and a bracket. The bracket may be used alternately to support a handle piece which is rotated in order to auger the post into the ground and to couple a support brace. Several units may be coupled to form a corner fence post. The base unit is equipped with a stabilizer device for lateral support.

U.S. Pat. No. 5,192,055 issued to Griggs et al. on Mar. 9, 1993 discloses a brace assembly for corner posts. The assembly has upper and lower bracket assemblies for a clamped engagement with a fence post. Each bracket assembly has angular bracket members which may include diagonal flanges which serve to receive the ends of adjustable braces. Lower bracket assemblies serve to attach ground engaging members to the post. The braces are axially adjustable for attachment to the ground engaging members which may be inclined for contact with sloped terrain. A modified form of a bracket assembly includes a clamping plate with a boss through which extends a gate pintle arm to permit a fence post to serve as a gate post. Another embodiment of the assembly includes a steel fence post to serve as a fence corner post with braces extending downwardly and rearwardly from the corner post. Additional bracing may extend horizontally from the corner post to adjacent fence posts. Another modified form of the brace assembly includes a bracket assembly utilizing four angular members to permit attachment to the post of several braces each with a corresponding ground engaging member.

U.S. Pat. Nos. 5,356,101 and 5,460,344 disclose a fence support having a generally vertically oriented main support post in the form of a T shaped iron bar and a single brace. The brace includes a top end having an elongated bearing element and a bottom end having a stake holder. The stake holder includes a tubular member vertically oriented for engaging a stake driven into the ground for additional support. The elongated bearing element is mounted by a hinge to the top end of the brace. The fence support further includes a collar member adapted to fit over the top of the main support post and bearing element to hold them together.

U.K. Pat. No. 1,557,781 discloses a post supporting assembly having a strut connected at the upper end of an embedded post. Supported at the other end of the strut is an anchoring means. A tie means is connected to one end of the anchoring means and at the other end to the post below the connection between the post and the strut means. The support assembly also includes a ground anchor connected to the post below the connection between the post and the tie means.

Generally from the above brief description of the prior art, it is clear that there is still a need for a fencing member, and preferably a fencing member having a cross-section substantially similar to a conventional T-post, that is easily installed and that can further be utilized as a lateral bracing member for a corner assembly without additional brackets, collars, and specialized bracing members.

SUMMARY OF THE INVENTION

Briefly, the present invention is a fencing unit having a front face or cross-bar member with a front surface and a back surface, a leg member affixed to the back surface and substantially perpendicular to the front face member so that the juncture of the front face member and the leg member substantially forms a "T" shaped cross-section, and an engaging means for engaging a T-post. In a preferred embodiment the fencing unit includes a plurality of spaced apart lug members, projections or protuberances extending from the front surface.

Another aspect of the present invention is a braced fencing assembly or arrangement having a first substantially vertical T-post with a second front face surface, and a plurality of spaced apart second lug members extending from the second front surface; and a second substantially vertical T-post with a third front face surface and a plurality of spaced apart third lug members extending from the third front surface. The fencing assembly utilizes the fencing unit described above with an engaging means positioned proximate to, and preferably at, each end to act as a lateral bracing member. To form the braced fence assemblage, the engaging means on a first end of the bracing member is engaged with the first vertical T-post between a pair of spaced apart second lug members and the engaging means on the opposing end of the bracing member is engaged with the second substantially vertical T-post between a pair of spaced apart third lug members.

Another aspect of the present invention is for a method of forming a braced fence arrangement or assemblage that includes the steps of providing a fencing unit as described above and having an engaging means at each employed as a bracing member; setting into the ground a first substantially vertical T-post having a second front face surface and a plurality of spaced apart second lug members extending from the second front surface; and setting into the ground a second substantially vertical T-post having a third front face surface and a plurality of spaced apart third lug members extending from the third front surface. The second T-post is spaced from the first T-post a predetermined distance that is less than the length of the bracing member, thereby allowing engagement of the bracing member with the first and second substantially vertical T-posts. The method further includes inserting the engaging means at one end of the bracing member between a pair of spaced apart second lug members on the first vertical T-post and inserting the engaging means at the other end of the bracing member between a pair of spaced apart third lug members on the second vertical T-post.

It is an object of the present invention to provide a fencing unit having a "T" shaped cross-section having an engaging means and which may be used as a bracing member.

Another object of the present invention is to provide a laterally braced fence assemblage that combines rigid support, economy of manufacture and ease of field fabrication.

Yet another object of the present invention is to provide a corner post brace assemblage that enables the construction of a fence corner that is essentially maintenance free for extended periods of time and is readily erected with a minimum of tools.

These and other objects and advantages of the present invention will become more apparent to those skilled in the art in view of the following description and the accompanying drawings wherein like parts and objects have similar reference numerals. It is to be understood that the inventive concept is not to be considered limited to the constructions disclosed herein but instead by the scope of the appended claims.

DETAILED DESCRIPTION OF THE INVENTION

Figure 2:
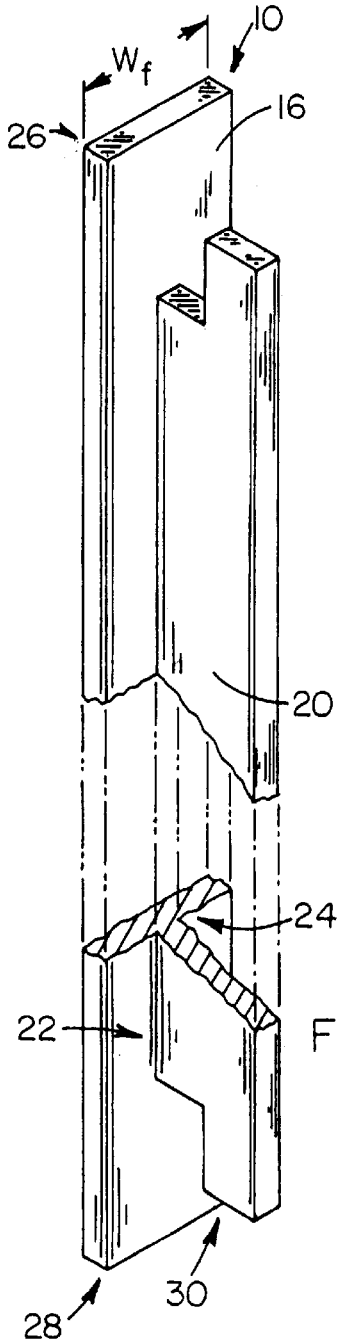
FIG. 2 is a partial perspective rear view of the fencing unit wherein an engaging means is illustrated on each end of the fencing unit.
Figure 1:
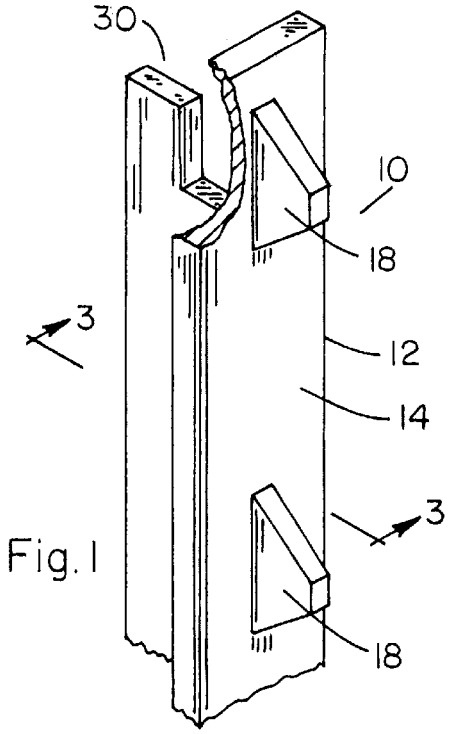
FIG. 1 is a partial perspective front view of a fencing unit of the present invention having a portion removed for clarity of description purposes only.

Referring to the figures of drawings in general, FIGS. 1–4 illustrate a portion of a preferred fencing unit denoted generally by the reference numeral 10. Although the description of the fencing unit 10 may be referred to herein in the singular, fencing units of the present invention and typically are used in pairs when bracing a corner assembly, which is described in greater detail below. Moreover, as used herein, "fencing unit" and "bracing member" are used interchangeably depending upon the use and function of the fencing unit, i.e., as a substantially vertical, stand-alone post member or used a lateral brace in stabilizing a substantially vertical post member along a fence row or a corner assemblage. The versatility of the fencing unit of the present invention is a distinct and unexpected advantage over fence posts and supports described in the prior art.

The fencing unit 10 is generally adapted, i.e., having sufficient structural integrety, to be driven into the ground using a sledge hammer or other driving means, whether manual or hydraulic. The fencing unit 10 has a front face member 12 that includes a forward facing front surface 14 and a back surface 16. The front face member 12 is generally a substantially flat metal structure having a predetermined first width, $W_f$, and a first thickness, $T_f$.

Optionally, the front face member 12 may have a plurality of spaced apart lug members , projections or protuberances 18 extending outwardly from the front surface 14. These lug member 18 are typically arranged in a single column along the longitudinal axis of the face member 12. The presence of the lug members 18 is preferable but is not necessary when the fencing unit is utilized as a bracing member such as in a corner assemblage. Generally, the lug members 18 facilitate stabilizing the fencing wire to prevent its movement along the T-post, particularly when used in combination with a wire clip, not shown, as is known to those skilled in the fence art.

Leg member 20 is affixed to the back surface 16 of the front member 12 so that the leg member 20 is roughly perpendicular to the front member 12 and substantially divides back surface 16 into left and right half sections 22 and 24, respectively. The juncture of the front face member 12 and the leg member 20 substantially forms a "T" shaped cross-section of the fencing unit 10, which further includes opposing first and second ends 26 and 28, respectively.

The fencing unit 10 further includes a fence engaging connector means 30 for affixing the fencing unit 10 to other T-posts, such as when constructing a laterally braced T-post or when constructing a corner assembly. Desirably, the engaging connector means 30 is positioned proximate to and preferably adjacent to at least one of the ends 26 or 28 of the fencing unit 10. More preferably, the fencing unit 10 includes an engaging connector means 30 at both ends 26 and 28. Although the engaging means 30 is illustrated and described herein as being positioned on the ends for ease of manufacture and maximizing the length of the bracing member, one skilled in the art will further appreciate that such engaging member may also be positioned inward from the ends 26 and 28, but this is not preferred.

Figure 3:
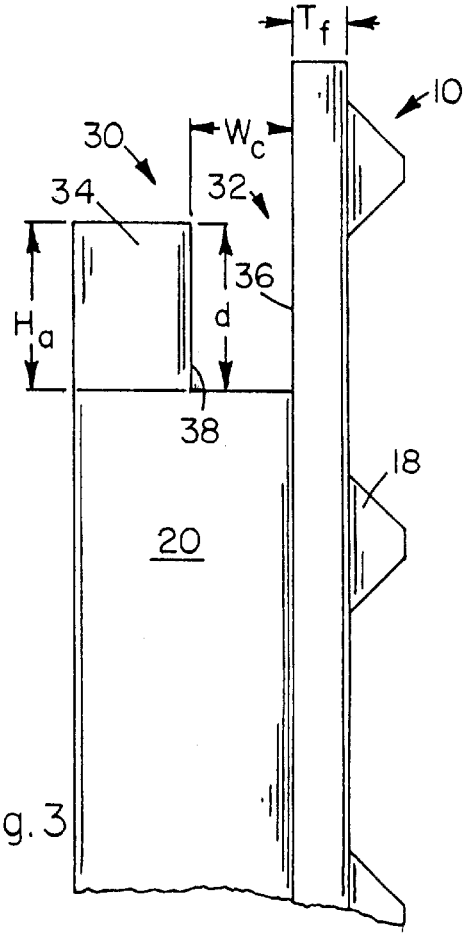
FIG. 3 is an enlarged side view taken along line 3—3 of FIG. 1 showing in greater detail the engagement means incorporated into the fencing unit.
Figure 4:
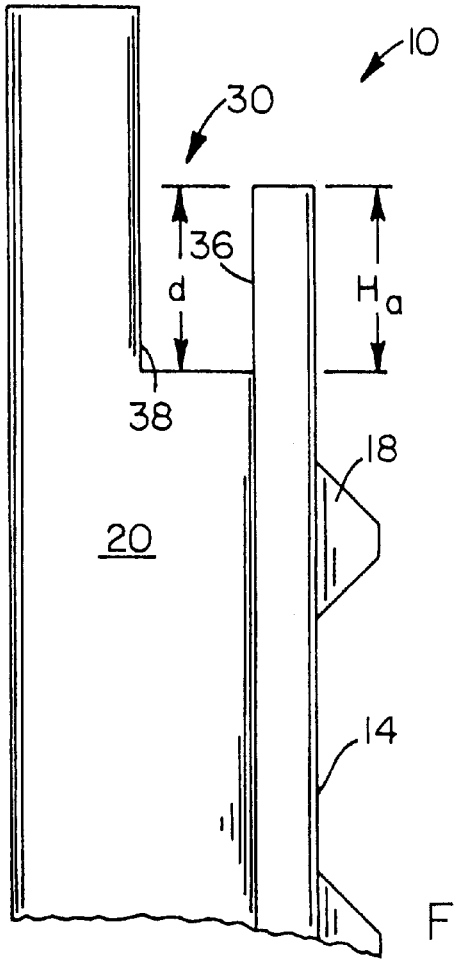
FIG. 4 is an enlarged view of an alternative embodiment of the engagement means incorporated into the fencing unit.

With particular reference to FIGS. 2–4, the engaging connector 30 includes a channel or notch portion 32 and an arm portion 34. The channel portion 32 generally is defined by opposing first and second sides 36 and 38, respectively. The first side 36 is desirably formed by a portion of the back surface 16 of the front face member 12. The opposing second side 38 of the channel 32 is desirably formed by a portion of leg member 18. The channel portion 32 also has a predetermined second width, $W_c$, defined by the distance between the first and second sides 36 and 38 such that $W_c$ is greater than the thickness $T_f$ of the front face member 12. The depth, d, of the channel 32 is equal to the length, $H_a$, of the arm portion 34, which may be less than the width of a half section 22 or 24 but preferably is equal to or greater than the width of a half section 22 or 24. More preferably, the depth, d, is about one-half of the first width $W_f$ which allows the fencing unit to have an angular bracing engagement with a fence T-post.

The arm portion 34 of the engaging connector means 30 may be formed from a portion of the front face member 12 but preferably is formed from a portion of the leg member 20. The length, $H_a$, is equal to the depth, d, of the channel 32. Accordingly, the length, $H_a$, may be less than the width of a half section 22 or 24 but preferably is equal to or greater than the width of a half section 22 or 24. More preferably the length of the arm portion 34 is about one-half of the first width $W_f$.

Referring to FIGS. 5–8 in conjunction with FIGS. 1–4, a braced fence arrangement or assembly 50 is shown. The braced assembly 50 utilizes the fencing unit 10 described above a bracing member. The bracing member 10 may further include a plurality of lug members 18 positioned on the front face member 12 and substantially along the longitudinal axis. The braced fence assembly 50 has a first substantially vertical T-post 52 having a second front face surface 54 and a plurality of spaced apart second lug members 56 extending outwardly from the second front surface 54 and which are aligned along a longitudinal axis of the first T-post 52. The first T-post 52 further includes a first upper portion 58 and a first lower portion 60.

In a somewhat conventional manner for a T-post type of fence construction, the braced assembly 50 also includes second substantially vertical T-post 62 having a third front face surface 64 and a plurality of spaced apart third lug members 66 extending outwardly from the third front surface 64 and are aligned along a longitudinal axis of the second T-post 62. The second T-post also has a second upper portion 68 and a second lower portion 70. The first T-post and second T-post are spaced apart a predetermined distance that is less than the length of the bracing member. As one skilled in the art will recognize, such bracing members 10 may have a length of from about 2 to about 16 feet, but preferably are from about 6 to about 10 feet in length.

Figure 7:
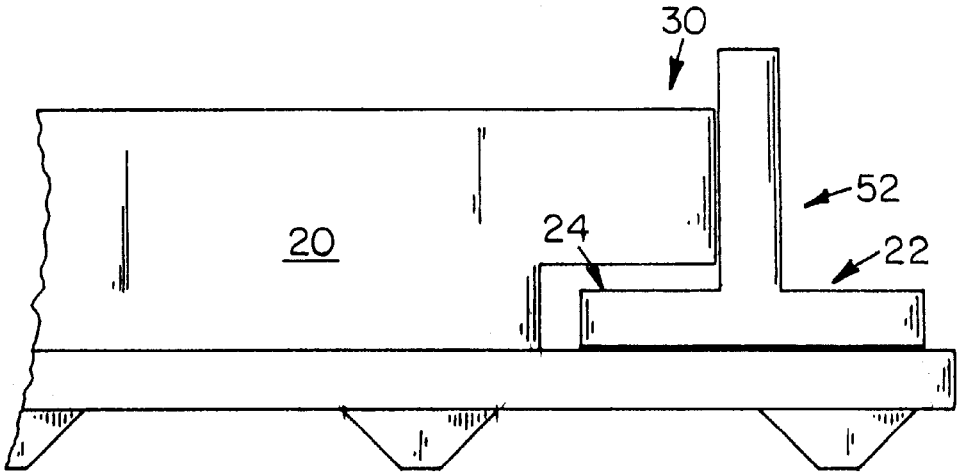
FIG. 7 is an enlarged view taken along section line 7—7 of FIG. 6 illustrating how the engaging means of the fencing unit engages a T-post when used as a laterally bracing member.

In constructing the fence assembly 50, the fence engaging connector means 30 on the first end 26 of the bracing member 10 is engaged with the first T-post 52 between a pair of spaced apart second lug members 56 in such a manner that a portion of a half section 22 or 24, depending on which side the brace member 10 is positioned relative to the first T-post 52, is captured in the channel 32, that is, between the arm portion 34 and the back surface 16 of the front member 12, as seen in FIG. 7. Advantageously, the width, $W_f$, of the front member 12 is less than the spacing between individual second lug members 56 so that the bracing member 10 may be angled from 0 degrees to about 25 degrees, and preferably from 0 degrees to about 60 degrees and more preferably from 0 to about 85 degrees, relative to the ground and adjacent T-post.

In a like manner, the fence engaging connector means 30 on the second end 28 of the bracing member 10 is engaged with the second T-post 62 so that the bracing member is engaged with the second T-post 62 between a pair of spaced apart third lug members 66.

Figure 5:
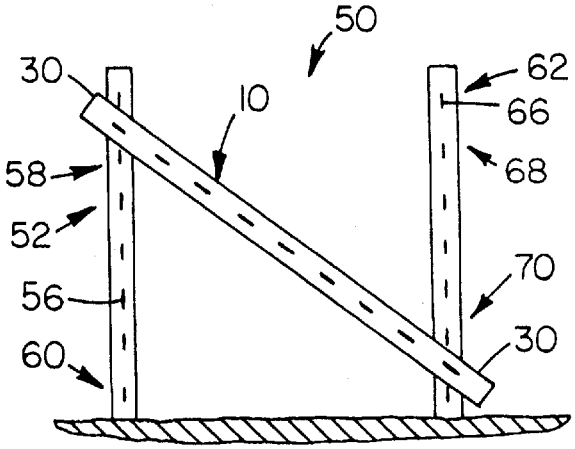
FIG. 5 is an elevation view of a braced fence assemblage wherein the fencing unit of the present invention is employed as a lateral bracing member.

Accordingly, a braced fence assembly 50 can be constructed so that the bracing member 10 is positioned at an acute angle, and preferably is at an angle from about 30 to 60 degrees and preferably from about 25 to about 45 degrees, relative to the ground and adjacent T-post, by positioning the engaging connector means 30 on the first end 26 so that it engages the first upper portion 58 between a pair of second lug members 56 and the engaging means 30 on the second end 28 engages the second lower portion 70 desirably between a pair of third lug members 66, as seen in FIG. 5.

Figure 6:
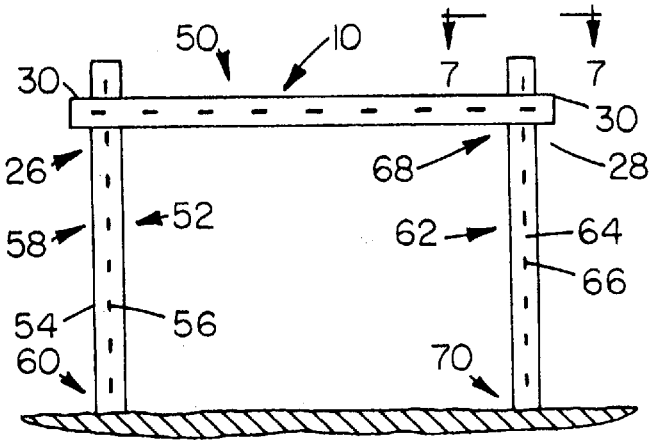
FIG. 6 is an elevation view of an alternative embodiment of a braced fence assemblage wherein the fencing unit of the present invention is employed as a lateral bracing member.

Alternatively, it is possible to construct a braced fence assembly where the brace member 12 is substantially perpendicular to first and second T-posts 52 and 62, respectively, by positioning the engaging connector means 30 on the first end 26 so that it engages the first T-post 52 in the first upper portion 58 between a pair of second lug members 56 and the engaging connector 30 on the second end 28 engages the second T-post 62 in the second upper portion 68 between a pair of third lug members 66, as seen in FIG. 6.

Figure 8:
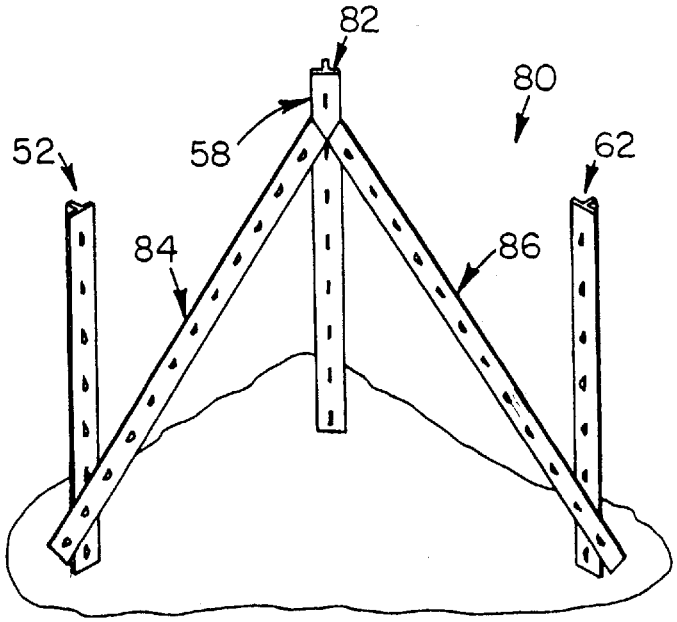
FIG. 8 is a perspective view of a corner fence assemblage wherein a plurality of fencing units are employed in a bilateral bracing arrangement.

Referring to FIG. 8, a braced corner assembly 80 is shown wherein three substantially vertical T-posts are utilized and one of the T-posts is a corner post. The corner post 82 is bilaterally supported by using a pair a brace members 84 and 86 that are similar to the brace member 10 described above. Each brace member 84 and 86 has a fence engaging connector means 30 at each end. The brace members 84 and 86 are engaged with the first T-post 52 and second T-post 62 so that each brace member 84 and 86 have one end engaging the upper portion of the corner post and the other end of the brace members 84 and 86 engaging the lower portion of the first and second T-posts 52 and 62, respectively. The first T-post 52 and second T-post 62 are positioned so that each is in a coplanar relationship relative to the plane of the corner post 82, but desirably reside in planes that are substantially perpendicular to each other.

There are several varying suitable methods in which to assemble a braced arrangement or section of fencing utilizing the fencing unit or bracing member 10. One preferred method is as follows:

Referring to FIGS. 1–6, a bracing member 10 as described above and having a fence engaging connector means 30 positioned on the first and second ends 26 and 28, respectively, is provided. A first T-post 52, as described above, is set into the ground by using a manual driving means, such as a hammer, sledge hammer, or a post driver. The engaging connector means 30 on the first end 26 of the brace member 10 is positioned between a pair of spaced apart second lug members 56 on the first T-post 52. The brace member 10 is set at an angle determined by the user of from between 0 and 85 degrees, relative to the ground, to determine the location of the second T-post 62. Using the brace member 10 as a measuring gage will provide a quick and simple method for determining the proper spacing between the two posts for later placement of the bracing member 10. A second T-post 62 as described above is set into the ground by using a manual driving means, such as a hammer, sledge hammer, or a post driver, thus providing two substantially vertical T-posts extending out of the ground that are at a distance that this less than the length of the bracing member 10. The fence engaging connector means 30 on the first end 26 of the bracing member 10 is inserted or engaged between a pair of spaced apart second lug members 56 in the first upper portion 58 of the first T-post 52 in such a manner that a half section 22 or 24, depending on which side the brace member 10 is positioned relative to the first T-post 52, is captured in the channel 32, between the arm portion 34 and the back surface 16 of the front member 12 of the bracing member 10. The fence engaging connector means 30 on the second end 28 of the bracing member 10 is inserted or engaged between a pair of spaced apart third lug members 66 in the second lower portion 70 of the second T-post 62 in such a manner that a half section is likewise captured in the channel 32 of the second engaging means, between the arm portion 34 and the back surface 16 of the front member 12 of the bracing member 10 so that the bracing member is engaged with the second T-post 62.

Having described the invention in detail, those skilled in the art will appreciate that modifications may be made to the various aspects of the invention without departing from the scope and spirit of the invention disclosed and described herein. It is, therefore, not intended that the scope of the invention be limited to the specific embodiments illustrated and described but rather it is intended that the scope of the present invention be determined by the appended claims and their equivalents. Moreover, all patents, patent applications, publications, and literature references presented herein are incorporated by reference in their entirety for any disclosure pertinent to the practice of this invention.

I claim:

1. A fencing unit comprising:

a front face member having front and back surfaces, a first width and a first length;

a leg member rigidly affixed to said back surface and substantially perpendicular to said front face member whereby the juncture of said front face member and said leg member substantially forms a "T" shaped cross-section; and engaging means in said fencing unit for engaging said fence unit with a T-post wherein said engaging means comprises a channel and an arm portion in said leg member.

2. The fencing unit of claim 1 further comprising spaced apart first and second ends and said engaging means is positioned proximate to at least one of said ends.

3. The fencing unit of claim 2 wherein an engaging means is positioned proximate to each of said first and second ends.

4. The fencing unit of claim 1 further comprising a plurality of spaced apart lug members extending from said front surface.

5. The fencing unit of claim 1 wherein said channel comprises opposing first and second sides and a second width defined by a distance between said first and second sides, wherein said first side is defined by a portion of said back surface and said second side is defined by a portion of said leg member and said second width is greater than a thickness of said front face member.

6. The fencing unit of claim 5 wherein said channel further comprises a depth of about one-half of said first width.

7. The fencing unit of claim 1 wherein said arm portion is formed from a portion of said leg member and has a length of about one-half of the first width.

8. A fencing unit comprising:

a front face member having front and back surfaces, a first width and a first length;

a plurality of spaced apart lug members extending from said front surface;

a leg member rigidly affixed to said back surface and substantially perpendicular to said front face member whereby the juncture of said front face member and said leg member substantially forms a "T" shaped cross-section; and engaging means on said fencing unit for engaging said fencing unit with a T-post, said engaging means comprising a channel and an arm portion in said leg member, wherein said channel includes opposing first and second sides and a second width defined by a distance between said first and second sides, wherein said first side is defined by a portion of said back surface and said second side is defined by a portion of said leg member, and wherein said second width is greater than a thickness of said front face member; and said arm portion is formed from a portion of said leg member and has a length of about one-half of the first width.

9. The fencing unit of claim 8 wherein said channel further comprises a depth of about one-half of said first width.

10. The fencing unit of claim 8 further comprising spaced apart first and second ends and said engaging means is positioned at one of said ends.

11. The fencing unit of claim 10 wherein said first and second ends each includes an engaging means.

12. A braced fence arrangement comprising:

a bracing member comprising the fencing unit of claim 11;

a first substantially vertical T-post having a second front face surface, and a plurality of spaced apart second lug members extending from said second front surface; and a second substantially vertical T-post having a third front face surface and a plurality of spaced apart third lug members extending from said third front surface, wherein said second T-post is spaced from said first T-post a predetermined distance less than a length of said bracing member;

wherein said engaging means proximate to said first end of said bracing member is engaged with said first vertical T-post between a pair of spaced apart second lug members and said engaging means proximate to said second end of said bracing member is engaged with said second substantially vertical T-post between a pair of spaced apart third lug members.

13. The braced fence arrangement of claim 12 therein said first substantially vertical T-post further comprises a first upper portion and a first lower portion and said second substantially vertical T-post further comprises a second upper portion and a second lower portion, wherein said engaging means proximate to said first and second ends engages said first and second vertical T-posts in said first and second upper portions.

14. The braced fence arrangement of claim 12 wherein said first substantially vertical T-post further comprises a first upper portion and a first lower portion and said second substantially vertical T-post further comprises a second upper portion and a second lower portion, wherein said engaging means proximate to said first end engages said first upper portion and said engaging means on said second end engages said second lower portion.

15. The braced fence arrangement of claim 12 wherein one of said first or second substantially vertical T-posts is a corner post.

16. A method for forming a braced fence arrangement comprising:

providing a bracing member comprising a fencing unit of claim 12;

setting into the ground a first substantially vertical T-post having a second front face surface, and a plurality of spaced apart second lug members extending from said second front surface; and setting into the ground a second substantially vertical T-post having a third front face surface and a plurality of spaced apart third lug members extending from said third front surface, wherein said second T-post is spaced from said first T-post a predetermined distance less than a length of said bracing member;

inserting said engaging means on said first end of said bracing member between a pair of spaced apart second lug members on said first vertical T-post; and inserting said engaging means on said second end of said bracing member between a pair of spaced apart third lug members on said second vertical T-post.

17. The method for forming a braced fence arrangement of claim 16 wherein said first substantially vertical T-post further comprises a first upper portion and a first lower portion and said second substantially vertical T-post further comprises a second upper portion and a second lower portion, wherein said engaging means on said first and second ends engages said first and second vertical T-post in said first and second upper portions.

18. The method for forming a braced fence arrangement of claim 16 therein said first substantially vertical T-post further comprises a first upper portion and a first lower portion and said second substantially vertical T-post further comprises a second upper portion and a second lower portion, wherein said engaging means on said first end engages said first upper portion and said engaging means on said second end engages said second lower portion.

19. The method for forming a braced fence arrangement of claim 16 wherein one of said first or second substantially vertical T-posts is a corner post.

20. The method for forming a braced fence arrangement of claim 18 wherein said first substantially vertical T-post is a corner post.

* * * * *